United States Patent [19]

Hiraga

[11] Patent Number: 4,457,676

[45] Date of Patent: Jul. 3, 1984

[54] DRIVING SUPPORT MECHANISM FOR AN ORBITING SCROLL OF A SCROLL TYPE FLUID DISPLACEMENT APPARATUS

[75] Inventor: Masaharu Hiraga, Honjo, Japan

[73] Assignee: Sanden Corporation, Gunma, Japan

[21] Appl. No.: 382,086

[22] Filed: May 26, 1982

[30] Foreign Application Priority Data

May 27, 1981 [JP] Japan ..... 56-81702

[51] Int. Cl.[3] ..... F01C 1/02; F04C 2/02

[52] U.S. Cl. ..... 418/55; 418/57

[58] Field of Search ..... 418/55, 57, 59

[56] References Cited

U.S. PATENT DOCUMENTS

| | | | |
|---|---|---|---|
| 1,967,957 | 7/1934 | Lucas | 418/57 |
| 3,463,091 | 8/1969 | Delsuc | 418/59 |
| 4,259,043 | 3/1981 | Hidden et al. | 418/55 |
| 4,314,796 | 2/1982 | Terauchi | 418/57 |

FOREIGN PATENT DOCUMENTS

| | | | |
|---|---|---|---|
| 9355 | 4/1980 | European Pat. Off. | 418/55 |
| 37658 | 10/1981 | European Pat. Off. | 418/55 |

*Primary Examiner*—John J. Vrablik
*Assistant Examiner*—Theodore Olds
*Attorney, Agent, or Firm*—Banner, Birch, McKie & Beckett

[57] ABSTRACT

A scroll type fluid displacement apparatus is disclosed which includes a housing having a front end plate and a cup shaped casing. A fixed wrap extends into an operative interior area of the casing from an inner end surface of an end plate of the cup shaped casing. An orbiting scroll has an end plate from which an orbiting wrap extends, and an opening at the center of the end plate. A drive shaft is rotatably supported by the front end plate and a crank pin extends from its inner end surface. The crank pin is rotatably carried within the opening of the end plate of the orbiting scroll through a bearing to thereby rotatably support the orbiting scroll. The crank pin has a radial flange at its inner end surface and a spring washer is disposed between the radial flange and the bearing to urge the orbiting scroll against the front end plate.

5 Claims, 7 Drawing Figures

DRIVING SUPPORT MECHANISM FOR AN ORBITING SCROLL OF A SCROLL TYPE FLUID DISPLACEMENT APPARATUS

BACKGROUND OF THE INVENTION

This invention relates to a fluid displacement apparatus, and more particularly, to a scroll type fluid displacement apparatus for use as a supercharger for an engine or as an air pump.

Scroll type fluid displacement apparatus are well known in the prior art. For example, U.S. Pat. No. 801,182 (Creux) discloses a device including two scrolls, each having a circular end plate and a spiroidal or involute spiral element. These scrolls are maintained angularly and radially offset so that both spiral elements interfit to make a plurality of line contacts between their spiral curved surfaces to thereby seal off and define at least one pair of fluid pockets. The relative orbital motion of the scrolls shifts the line contacts along the spiral curved surfaces and, as a result, the volume of the fluid pockets changes. Since the volume of the fluid pockets increases of decreases dependent on the direction of the orbital motion, the scroll type fluid apparatus is applicable to compress, expand or pump fluids.

Scroll type displacement apparatus have been used as refrigeration compressors in refrigerators or air conditioning apparatus. Such compressors need high efficiency and a high compression ratio, such as a 5 to 10 compression ratio. In such a compressor, the re-expansion volume, i.e., the smallest volume of the fluid pockets in the compression cycle, which is located at the center of the scroll members in a scroll type compressor, must be reduced as much as possible. To this end, the inner end portions of the spiral elements are extended inwardly as far as possible to the center of the scroll member.

The conventional driving mechanism in a high compression ratio scroll type compressor is connected to the end plate of an orbiting scroll on a side opposite the spiral element. The acting point of the driving force of the driving mechanism on the orbiting scroll generally is displaced from the acting point of the reaction force of the compressed gas, which acts at an intermediate location along the height of the spiral element of the orbiting scroll. If the distance between these acting points is relatively long, a moment is created which adversely effects the stability of the orbiting scroll during orbital motion. Therefore, to compensate for this loss of stability, the length of the spiral element generally is limited, which in turn limits the volume of the apparatus.

The above limitation on the length of the spiral element is not a problem for a scroll type fluid displacement apparatus which requires a compression ratio of only 1.0 to 1.5, since the re-expansion volume need not be reduced as much as in a high compression ratio apparatus. In apparatus which requires only a low compression ratio, the difference between the high pressure space and the lower pressure space is smaller than in a high compression ratio apparatus, so that 1.5 to 2.0 revolutions of the spiral element generally is sufficient.

A scroll type fluid displacement apparatus having a driving mechanism for reducing pressure loss, which is needed to obtain high flow rates, is disclosed in copending application Ser. No. 354,512, filed on March 3, 1982. Although the driving mechanism in this application improves the stability of orbital motion of the orbiting scroll without interference with the flow of fluid in the center portion of the spiral elements, the driving crank must be durable to endure the centrifugal force of the orbiting scroll and to avoid bending at high rotation speeds. Generally, the driving mechanism disclosed in this copending application may not be entirely suitable for high rotation speeds.

SUMMARY OF THE INVENTION

It is a primary object of this invention to provide an improved scroll type fluid displacement apparatus having a low compression ratio, which is simple to construct and can be simply and reliably manufactured.

It is another object of this invention to provide a scroll type fluid displacement apparatus having a large range of rotation speeds, high reliability and long life.

It is a further object of this invention to provide a scroll type fluid displacement apparatus with increased mechanical efficiency and reduced pressure loss.

It is still another object of this invention to provide a scroll type fluid displacement apparatus with improved dynamic balance so that vibration of the apparatus is reduced.

A scroll type fluid displacement apparatus according to this invention includes a housing having a fluid inlet port and a fluid outlet port. A fixed scroll member is joined with the housing and has a first end plate from which a first wrap extends into an operative interior area of the housing. An orbiting scroll has a second end plate from which a second wrap extends. The first and second wraps interfit at an angular and radial offset to make a plurality of line contacts to define at least one pair of fluid pockets. A drive shaft is rotatably supported by the housing and has a crank pin extending from its inner end. The crank pin is rotatably carried within an opening of the second end plate to rotatably support the orbiting scroll. The crank pin has a radial flange at its inner end and a spring washer located between the radial flange and a bearing disposed within the opening of the second end plate for pushing the orbiting scroll against the housing.

Further objects, features and aspects of this invention will be understood from the following detailed description of a preferred embodiment of this invention, referring to the annexed drawings.

Figure 1:
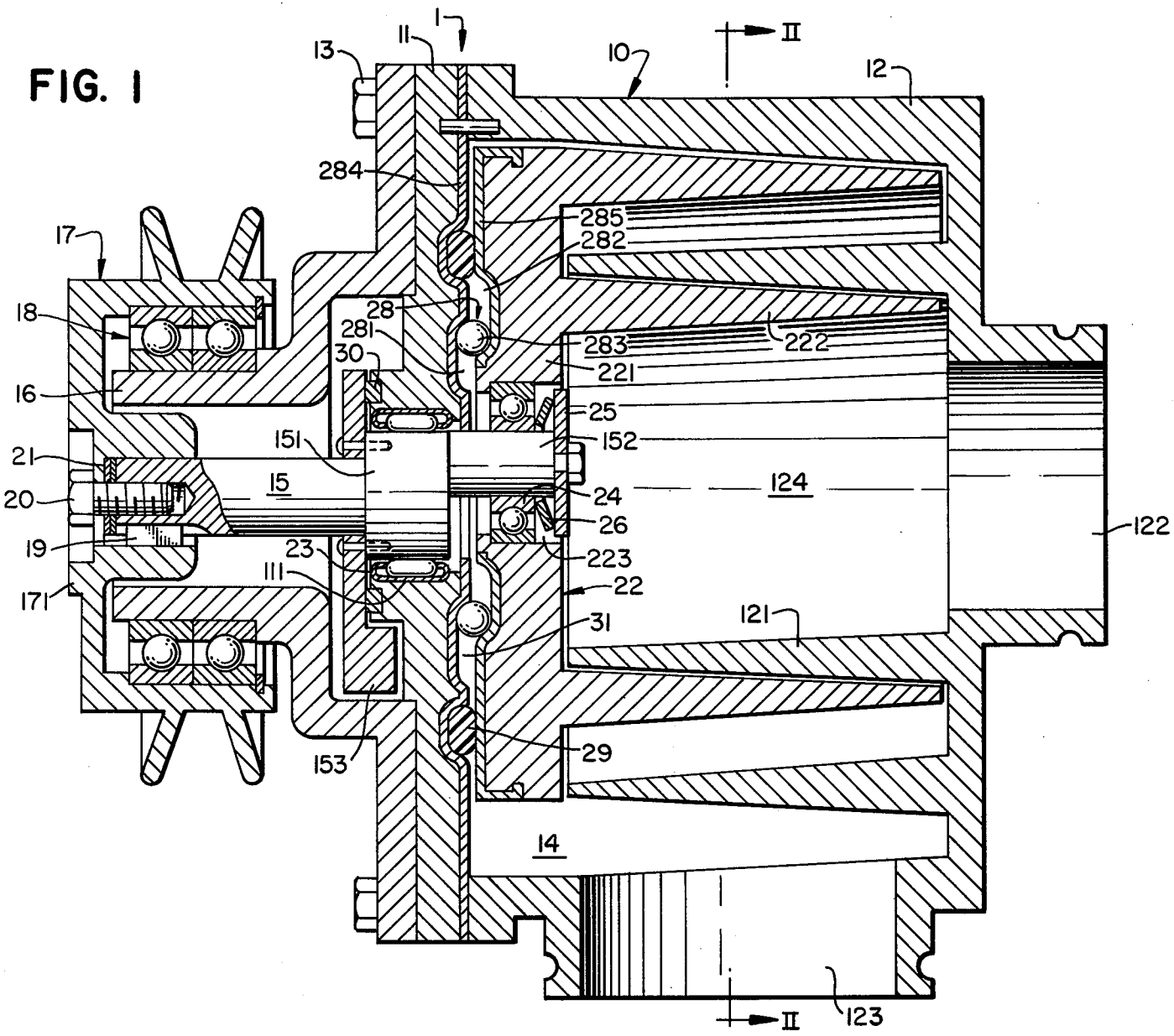
FIG. 1 is a vertical sectional view of a scroll type fluid displacement apparatus according to an embodiment of this invention.
Figure 3:
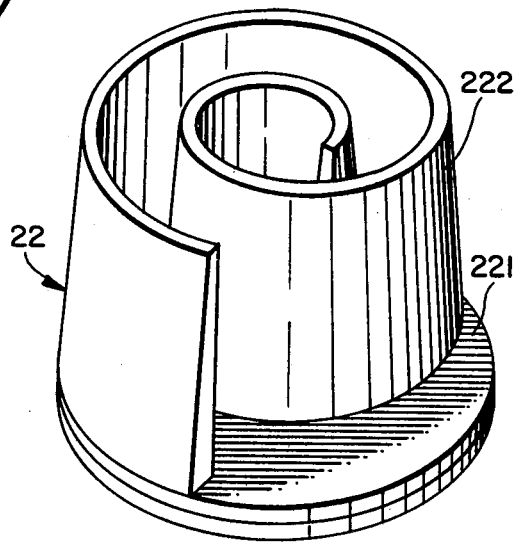
Figure 4:
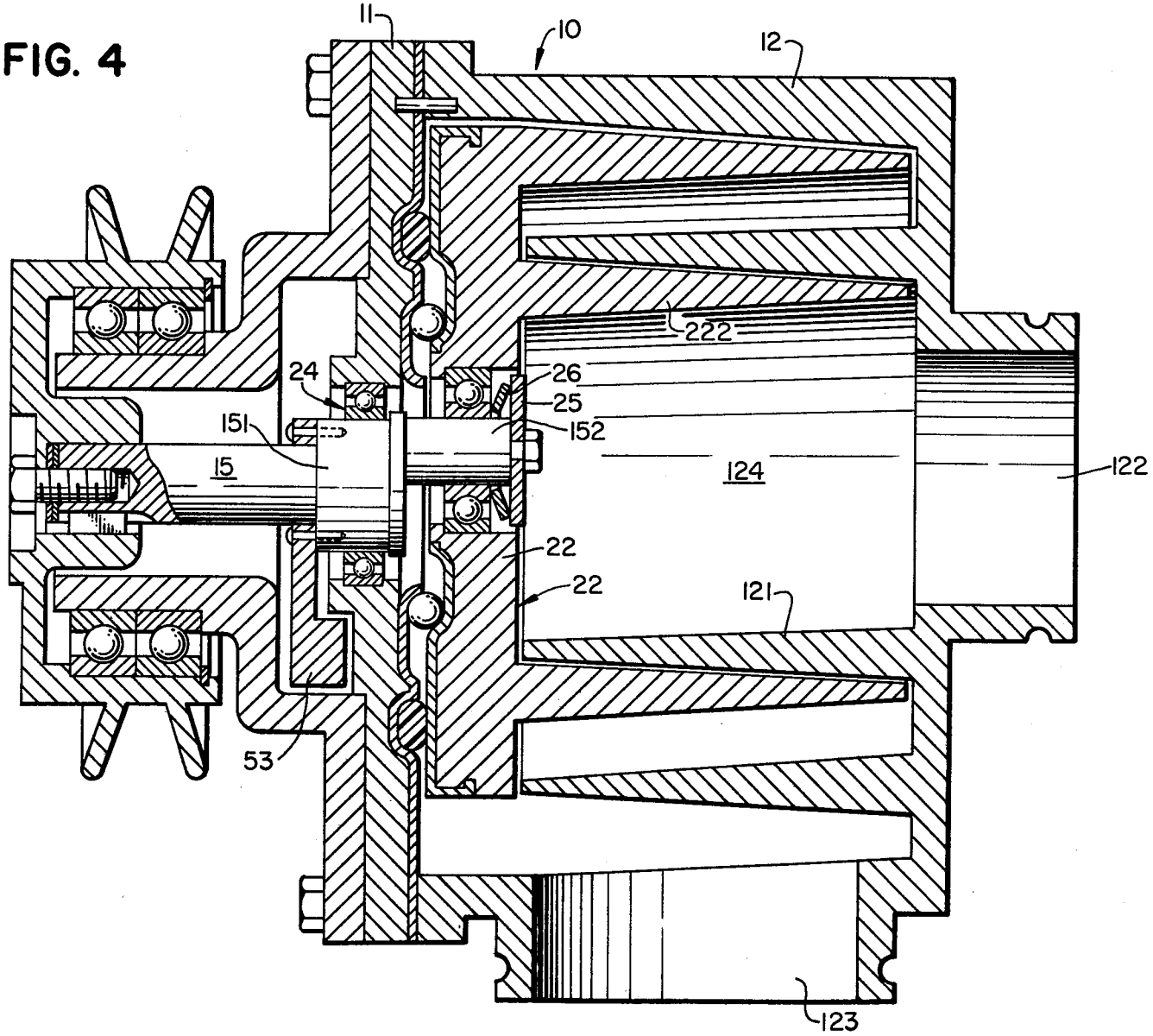

FIG. *2a–2d* are sectional views taken along line II—II in FIG. 1 illustrating the operation of the apparatus;

FIG. 3 is a perspective view of the orbiting scroll of the aparatus of FIG. 1; and FIG. 4 is a vertical sectional view of a scroll type fluid displacement apparatus according to another embodiment of this invention.

DETAILED DESCRIPTION OF THE INVENTION

Referring to FIG. 1, an embodiment of a fluid displacement apparatus in accordance with the present invention, in particular, scroll type fluid displacement apparatus 1, is shown. Apparatus 1 includes housing 10 having front end plate 11 and cup shaped casing 12, which is attached to one end surface of front end plate 11 by a plurality of bolts 13. An opening in cup shaped casing 12 is covered by front end plate 11 to seal off inner chamber 14 of cup shaped casing 12. Opening 111 is formed in the center of front end plate 11 for penetration or passage of drive shaft 15. Front end plate 11 has annular sleeve 16 projecting from the front end surface thereof which surrounds drive shaft 15. In the embodiment shown if FIG. 1, sleeve 16 is separated from front end plate 11. Therefore, sleeve 16 if fixed to the front end surface of front end plate 11 by bolts 13.

Pulley 17 is rotatably supported by bearing 18 which is carried on the outer surface of sleeve 16. The outer end portion of drive shaft 15, which extends from sleeve 16, is fixed on pulley 17 by key 19 and bolt 20 through shim 21. Drive shaft 15 is driven by an external drive power source through pulley 17.

Fixed spiral element 121 is formed integral with the end plate of cup shaped casing 12 and extends into inner chamber 14 of cup shaped casing 12. Spiral element 121, which has approximately 1 ¾ turns or revolutions, has a trapezoidal shape as shown in FIG. 1. Outlet port 122 is formed through the end plate of cup shaped casing 12 and inlet port 123 is formed through the outer peripheral surface of cup shaped casing 12.

Orbiting scroll 22 is also located within inner chamber 14 of cup shaped casing 12 and includes circular end plate 221 and orbiting wrap or spiral element 222 affixed to or extending from one side surface of circular end plate 221. Spiral element 222 also has a trapezoidal shape as shown in FIGS. 1 and 3. Opening 223 is formed in the center portion shaft 15. Fixed spiral element 121 and orbiting spiral element 222 interfit at an angular offset of 180° and a predetermined radial offset. At least a pair of fluid pockets are defined between spiral elements 121 and 222.

Drive shaft 15 has disk shaped rotor 151 at its inner end which is rotatably supported by front end plate 11 through bearing 23 located within opening 111 of front end plate 11. Crank pin 152 projects axially fron an axial end surface of disk shaped rotor 151 at a position which is radially offset from the center of drive shaft 15. Crank pin 152 is carried in opening 223 of end plate 221 by bearing 24. Accordingly, orbiting scroll 22 is rotatably supported by crank ping 152 through bearing 24.

Bearing 24 includes an inner race which is closely fitted on crank pin 152, an outer race which abuts against a shoulder portion of end plate 221 of orbiting scroll 22, and a plurality of ball elements retained between these races. Bearing 24 is thus held within opening 223 of the end plate 221. A spring washer 26 is disposed between a snap ring 25, which is fixed on the internal axial end surface of crank pin 152 by a bolt, and the bearing race to bias bearing 24 against the shoulder portion of end plate 221. Therefore, orbiting scroll 22 is pushed toward the front end plate 11 by spring washer 26 through bearing 24.

A balance weight 153 is fixed on the axial end surface of disk shaped rotor 151 on the side of the apparatus opposite crank pin 152 in order to cancel the dynamic imbalance caused by the centrifugal force of orbiting scroll 22. Pulley 17 also is provided with balance 171. Seal element 30 is disposed between the end surface of balance weight 153 and the outer end surface of disk shaped rotor 151.

Rotation preventing/thrust bearing device 28 is located between the inner end surface of front end plate 11 and an axial end surface of end plate 221 of orbiting scroll 22. Rotation preventing/thrust bearing device 28 includes fixed indentations 281 formed on the inner end surface of front end plate 11, a plurality of orbiting indentations 282 formed on the axial end surface of end plate 221 and, a plurality of bearing elements, such as balls 283. Each ball 283 is placed in facing, generally aligned indentations 281 and 282. The rotation of orbiting scroll 22 is prevented by the interaction between balls 283 and indentations 281 and 282; also, the axial thrust load from orbiting scroll 22 is supported by front end plate 11 and orbiting scroll are formed of light alloy metal, for example, aluminum alloy, to reduce the weight of the apparatus. As a result, fixed and orbiting cover plates 284 and 285 are disposed on the inner end surface of front end plate 11 and the end surface of end plate 221 to prevent wear of indentations 281 and 282.

Grease seal mechanism 29 is placed between the outer peripheral portion of end plate 221 of orbiting scroll 22 and the inner end surface of front end plate 11. Grease, which is enclosed within a sealed off space 31 between front end plate 11 and end plate 221 of orbiting scroll 22, is retained to lubricate bearing 23 and rotation preventing/thrust bearing device 28. In one embodiment, bearing 24, which is located in opening 223 of end plate 221, has a grease seal mechanism and, the surface between balance weight 153 and disk shaped rotor 151 is sealed off by the seal element 30. Alternatively, bearing 24 has a grease seal mechanism, as shown in FIG. 4.

Figure 2A:
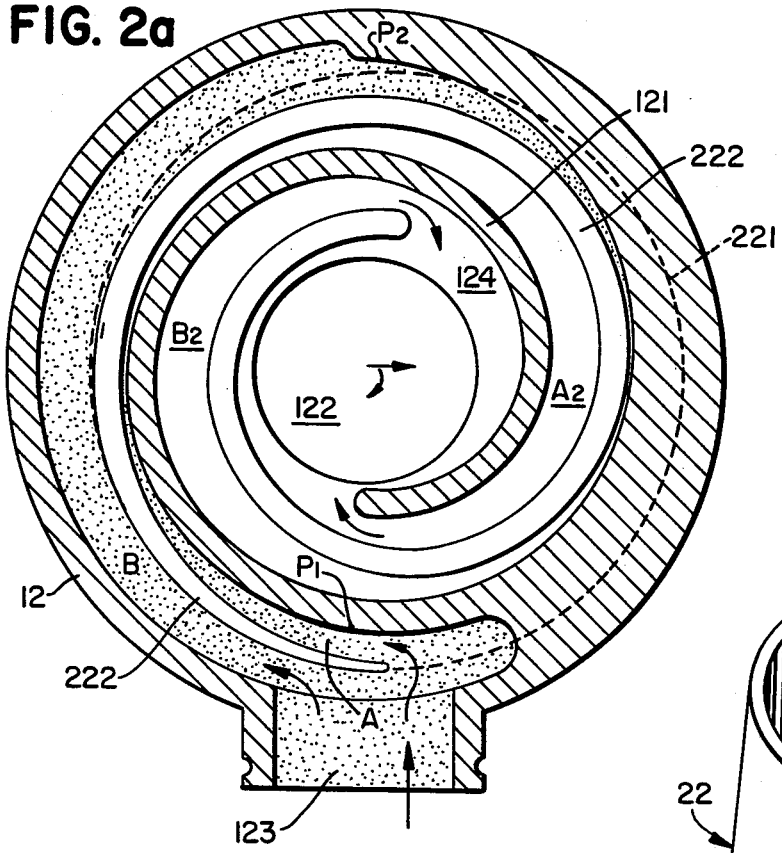
Figure 2B:
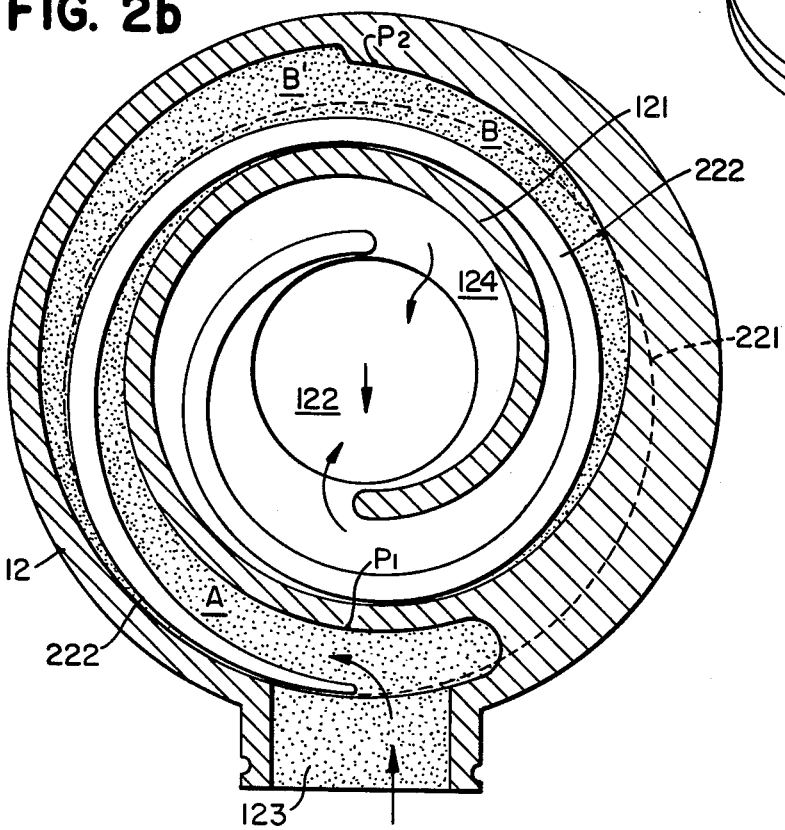

Referring now to FIGS. 2*a*–2*d*, a-2d, the operation of this apparatus as an air pump, will be explained. As shown in FIG. 2*a*, fixed spiral element 121 and orbiting spiral element 222 interfit at an angular and radial offset with a small radial gap. Air introduced through inlet port 123 flows into inner chamber 14 of cup shaped casing 12 and into space A formed by the inner side wall of spiral element 22, the inner wall of casing 12 and the outer side wall of orbiting spiral element 222 and the inner side wall of fixed spiral element 121. The relative positions of the spiral elements after the drive shaft 15 rotates 90° is shown in FIG. 2*b*. The outer side wall of orbiting spiral element 222 now fits against the inner side wall of cup shaped casing 12, since the outer side wall of orbiting spiral element has an annular shape. Thus, space B is sealed off by the inner side wall of cup shaped casing 12 and the outer side wall of orbiting spiral element 222. However, since the diameter of end plate 221 (the outline of end plate 221 is shown by the dotted line if FIG. 2*b*) is smaller than the diameter of cup shaped casing 12 to permit orbital motion of orbiting scroll within cup shaped casing 12, space B is connected to the inner chamber 14 of cup shaped casing 12 on the axial side. Accordingly, the pump operation does not start in this stage.

Figure 2C:
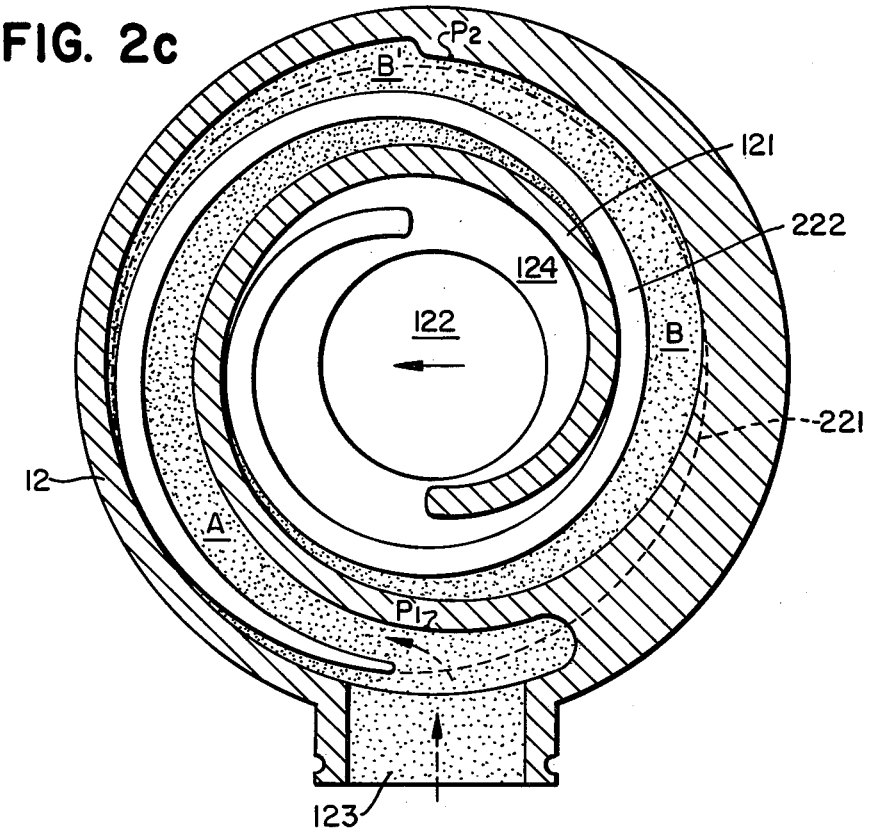
Figure 2D:
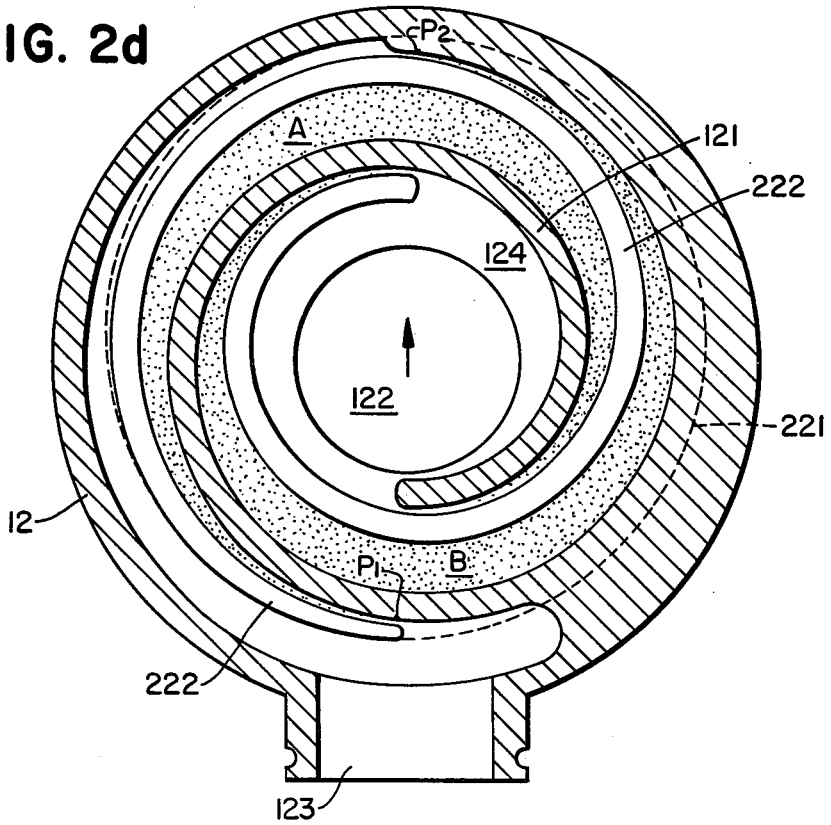

The relative positions of the spiral elements after drive shaft 15 rotates another 90° is shown in FIG. 2*c*. Spaces A and B are still connected to inner chamber 14 of cup shaped casing 12. Therefore, this stage is still a suction stage. When drive shaft 15 rotates 360° (see FIG. 2*d*), the inner side wall of orbiting spiral element 222 contacts point $P_1$ on the outer side wall of fixed spiral element 121 and the outer side wall of orbiting spiral element 222 contacts point $P_2$ on the inner side wall of fixed spiral element 121 to seal off spaces A and B. Since both spiral elements 121 and 222 have approximately 1¾ turns or revolutions, upon passage of the spiral elements from the stage shown in FIG. 2*c* to the stage shown in FIG. 2*a*, two spaces A and B are connected to center space 124 of the spiral elements which is in turn connected to outlet port 122. As a result, air within spaces A and B flows into center space 124 and is reduced in volume. Upon further rotation of drive shaft 15, the air within spaces $A_1$ and $B_1$ is discharged through outlet port 122.

As described above, orbiting scroll 22 usually is pushed against rotation preventing/thrust bearing device 28 by spring washer 26 placed between bearing 24 and snap ring 25. Accordingly, orbiting scroll 22 undergoes orbital motion. Furthermore, drive shaft 15 is supported by two axially spaced bearings 18 and 23 which ensure proper rotation of drive shaft 15.

Rotation prevention/thrust bearing device 28 and bearing 24 can be lubricated by grease enclosed between the end plate of orbiting scroll 22 and the inner end surface of front end plate 11. Leakage of grease is prevented by a sealing mechanism. Therefore, lubrication of bearing 24 and rotation preventing/thrust bearing 28 is obtained.

This invention has been described in detail in connection with the preferred embodiment, but this is an example only and the invention is not restricted thereto. It will be easily understood by those skilled in the art that other variations and modifications can be easily made within the scope of this invention.

I claim:

1. In a scroll type fluid displacement apparatus including a housing having an inlet port and an outlet port, a fixed scroll fastened to said housing and having a first end plate from which a first wrap extends into an operative interior area of said housing, an orbiting scroll having a second end plate from which a second wrap extends, said first and second wraps interfitting at an angular and radial offset to make a plurality of line contacts to define at least one pair of fluid pockets within said operative interior area, a driving mechanism connected to said orbiting scroll to drive said orbiting scroll in an orbital motion, and rotation preventing means for preventing the rotation of said orbiting scroll so that the volume of the fluid pockets changes during the orbital motion of said orbiting scroll, the improvement comprising a driving mechanism including a drive shaft rotatably supported by said housing, a crank pin axially projecting from an inner end of said drive shaft, said second end plate of said orbiting scroll having a centrally located opening, said crank pin being rotatably carried in said centrally located opening by a bearing, a radial flange fastened to the inner end of said crank pin and spring means disposed between said radial flange and said bearing for urging said orbiting scroll against said rotation preventing means.

2. The scroll type fluid displacement apparatus of claim 1 wherein a sealed off space is formed by an axial end surface of said second end plate and an inner end surface of said housing and grease is enclosed in said sealed off space.

3. The scroll type fluid displacement apparatus of claim 2 wherein said bearing includes a first sealing mechanism and said bearing is located within said centrally located opening, said apparatus further comprising a second sealing mechanism disposed beween the inner end surface of said housing and the axial end surface of said second end plate.

4. The scroll type fluid displacement apparatus of claim 3 wherein a second bearing is disposed in said housing to support said drive shaft, said second bearing including a sealing mechanism.

5. The scroll fluid displacement apparatus of claim 1 wherein said driving mechanism further comprises a balance weight, coupled to said drive shaft to balance said drive shaft.

* * * * *